US005442939A

United States Patent [19]

Crawford et al.

[11] Patent Number: 5,442,939

[45] Date of Patent: Aug. 22, 1995

[54] CARRIER FOR SUPPORTING TEXTILE MATERIAL IN A WET TREATMENT MACHINE

[75] Inventors: David R. Crawford; Matthew A. Meeker; Thomas W. Van Scyoc, all of Stanley, N.C.

[73] Assignee: Gaston County Dyeing Machine Co., Stanley, N.C.

[21] Appl. No.: 134,912

[22] Filed: Oct. 12, 1993

Related U.S. Application Data

[63] Continuation-in-part of Ser. No. 49,835, Apr. 19, 1993.

[51] Int. Cl.[6] ..... D06B 5/18

[52] U.S. Cl. ..... 68/198

[58] Field of Search ..... 68/189, 198; 242/130, 242/130.4

[56] References Cited

U.S. PATENT DOCUMENTS

| | | | |
|---|---|---|---|
| 1,511,380 | 10/1924 | Traver | 68/189 |
| 2,125,937 | 8/1938 | Little et al. | 68/189 |
| 2,437,987 | 3/1948 | Wolfenden | 68/198 |
| 2,562,220 | 7/1951 | Stienen | 68/188 |
| 2,679,153 | 5/1954 | Annicq | 68/198 |
| 3,225,573 | 12/1965 | Johnels | 68/198 |
| 3,433,432 | 3/1969 | Willis | 68/198 X |
| 3,596,481 | 8/1971 | Wilcox | 68/150 |
| 3,731,502 | 5/1973 | Stearns et al. | 68/198 |
| 4,452,055 | 6/1984 | Lejeune et al. | 68/189 |
| 4,720,986 | 1/1988 | Fuchs et al. | 68/198 |
| 4,825,668 | 5/1989 | Villard et al. | 68/189 |
| 4,884,418 | 12/1989 | Barriquand et al. | 68/150 |
| 5,172,443 | 12/1992 | Christ | 68/189 X |

FOREIGN PATENT DOCUMENTS

| | | | |
|---|---|---|---|
| 0110058 | 1/1987 | European Pat. Off. . | |
| 0468566 | 1/1992 | European Pat. Off. | 68/189 |
| 1039463 | 9/1958 | Germany | 68/189 |
| 2165540 | 7/1973 | Germany | 68/189 |
| 1018580 | 1/1966 | United Kingdom . | |
| 2062036 | 5/1981 | United Kingdom . | |

*Primary Examiner*—Philip R. Coe

*Attorney, Agent, or Firm*—Shefte, Pinckney & Sawyer

[57] ABSTRACT

Textile yarn package supporting carriers are disclosed for use in both horizontal and vertical textile dyeing machines to enable the machine to be effectively operated at less than full capacity, Each carrier has a base with multiple upstanding package supporting posts each having a longitudinal package supporting portion adjacent the base and a longitudinal threaded spindle portion extending outwardly in alignment therewith, The package supporting portion is dimensioned to securely support a predetermined minimum number of packages on each post and adapters are provided for slidable mounting onto the spindle portions of each post to accommodate additional yarn packages up to the maximum capacity of the carrier. A threaded cap mounts to the spindle portion of each post for movement therealong into engagement with the outermost package on the post.

38 Claims, 8 Drawing Sheets

CARRIER FOR SUPPORTING TEXTILE MATERIAL IN A WET TREATMENT MACHINE

CROSS REFERENCE TO RELATED APPLICATION

This is a continuation-in-part of U.S. patent application Ser. No. 08/049,835, filed Apr. 19, 1993, pending entitled HORIZONTAL WET TREATMENT MACHINE FOR TEXTILES AND TEXTILE MATERIAL CARRIERS THEREFOR.

BACKGROUND OF THE INVENTION

The present invention relates generally to textile wet treatment machines and more particularly to a carrier for supporting packages of textile material during processing in a wet treatment machine such as, for example, textile yarn package dyeing machines.

Textile package dyeing machines normally have a Cylindrical pressurizable vessel into which packages of textile material to be wet processed, e.g., yarn packages wound on cylindrical spools, are arranged in vertical stacks on supporting vertical tubes arranged in spaced relation over the interior of the dye vessel. Such dyeing machines basically are of two types, commonly referred to as vertical dyeing machines, i.e., wherein the cylindrical vessel is oriented vertically with an openable lid at the upper end of the vessel for vertical insertion and removal of yarn packages to be dyed, and horizontal dyeing machines, wherein the cylindrical vessel is oriented horizontally with an openable lid at one end for horizontal insertion and removal of yarn packages to be dyed.

In both horizontal and vertical dyeing machines, it is conventional practice to support the yarn packages on a removable carrier which, in the case of vertical machines, can be lifted and lowered and, in the case of horizontal machines, can be horizontally transported on tracks or conveyors, for inserting and removing the yarn packages into and from the dye vessel. Conventional carriers of this type basically comprise a base with a plurality of upstanding tubes mounted in a spaced arrangement to the base. Yarn packages are slidably mounted over the upper ends of the tubes in a stacked arrangement and are secured by a cap threaded onto a compatibly threaded upper end portion of each tube. The upstanding tubes are hollow and perforated and communicate with concentric openings formed through the base to permit dye liquor to flow axially through the tubes and radially through the yarn packages.

While such carriers function satisfactorily and advantageously when supporting a full capacity of yarn packages, difficulties are encountered in dyeing smaller lots of yarn packages which do not require each tube to be fully stacked with yarn packages. In such cases, it is highly undesirable to fill the dye vessel with dye liquor to the same volume utilized when dyeing a full capacity of yarn packages. Accordingly, the volume of the dye bath is reduced commensurate with the number of yarn packages actually being dyed, but since the lesser volume of the dye bath will result in the level of the bath being below the upper end of the perforated package-supporting tubes, appropriate measures must be taken to cover the exposed perforations. Conventionally, this is accomplished in one of two manners, either by placing a tubular cover over the exposed length of each perforated tube to block the perforations in the tube or by situating one or more volumetric displacement elements within the carrier or otherwise within the dye vessel to raise the level of the lesser volume of dye liquor to the level occupied during full capacity dyeing. Disadvantageously, however, volumetric displacers increase the risks of potential contamination of the dye liquor, while the tubular covers may not fully seal the exposed perforations in the package-supporting tubes, thereby risking the possibility that air may be drawn into the pump of the dyeing machine used for circulating the dye liquor.

SUMMARY OF THE INVENTION

It is accordingly an object of the present invention to provide an improved package carrier for use in wet treatment machines which enables diverse numbers of textile yarn and like material packages to be selectively supported during wet processing operations without the disadvantages of the conventional techniques described above.

Briefly summarized, the carrier of the present invention basically includes a base and one or more post assemblies extending outwardly from the base for mounting a plurality of the textile material packages in series about each post. Each post has a longitudinal package supporting portion adjacent the base and a longitudinal spindle portion extending outwardly from and in alignment with the package supporting portion. The package supporting portion of each post is of predetermined lengthwise and transverse dimensions for centrally supporting a predetermined minimum number of the annular textile material packages securely on the post. A package supporting adapter is provided for mounting to and demounting from the spindle portion of each post at a position therealong in longitudinal adjacency to the package supporting portion of the post, the adapter being of predetermined lengthwise and transverse dimensions for centrally supporting a predetermined number of the annular textile material packages securely on each post in addition to the predetermined minimum number supported by the package supporting portion of the post. A package retaining cap is mountable to and demountable from the spindle portion of each post for selective disposition at differing package retaining positions therealong in engagement with the outermost one of the textile packages supported on the post.

Preferably, a set of several adapters of differing lengths are provided for each post to enable selective alternative mounting of differing adapters on the spindle portions of the posts for supporting thereon differing pluralities of textile material packages. Thus, by the selective use of an appropriate one of the adapters on each post, or the selective non-use of adapters on the posts, the package supporting capacity of the carrier can be readily varied, in turn enabling a corresponding reduction to be achieved in the required volume of processing liquid in the wet treatment machine without risk of contamination or risk of drawing air into the pump of the machine.

Preferably, the base of the carrier includes a liquid flow opening for each post and each post includes an annular mounting portion affixed to the base about the liquid flow opening for liquid communication therethrough with the annular interior of the textile packages supported on the posts. In one embodiment, the annular mounting portion of each post may comprise a mounting plate rigidly affixed to the carrier base. In an alternative embodiment, threaded bores in the base define the liquid flow openings and the mounting portions of the posts are in the form of threaded tubes compatibly engageable in the threaded bores.

The package supporting portion of each post is configured to permit liquid flow axially through the annular interior of the textile packages. For example, each package supporting portion may comprise a plurality of radially outwardly extending package supporting struts. Likewise, the package supporting adapters similarly permit liquid flow axially through the textile packages. For this purpose, each adapter preferably has a sleeve for slidable mounting to and demounting from the spindle portion of a post, with plural radially outwardly extending package supporting struts being affixed to the sleeve.

The package retaining cap is mounted to the spindle portion of its respective post for lengthwise movement therealong, preferably by providing the spindle portion and the package retaining cap with compatible screw threads.

Carriers in accordance with the present invention may be appropriately configured in differing embodiments for use in either horizontal-type wet treatment machines or vertical-type wet treatment machines.

DESCRIPTION OF THE PREFERRED EMBODIMENT

Figure 1:
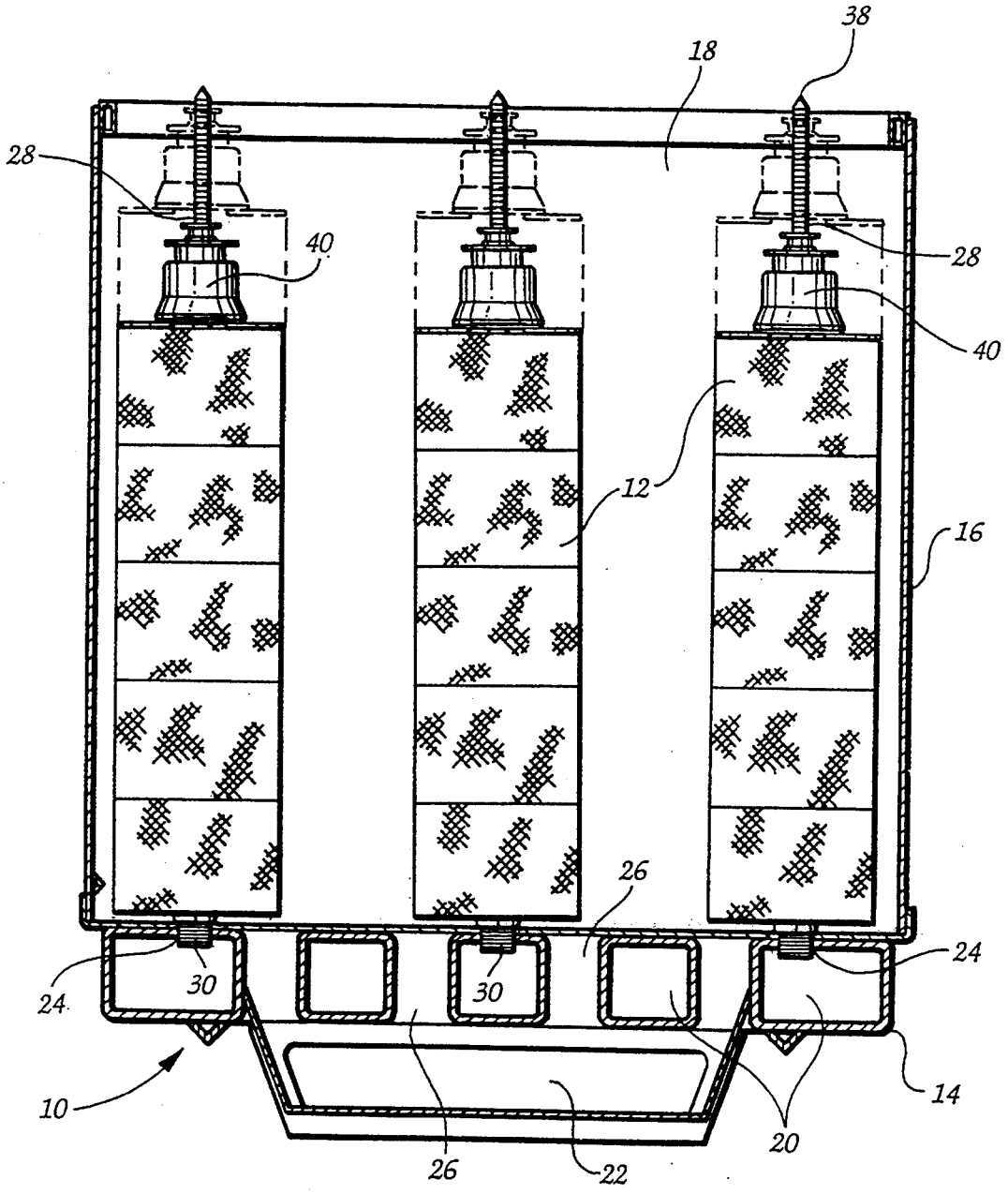
FIG. 1 is a vertical cross-sectional view of a carrier for supporting textile yarn packages for insertion into a textile wet treatment machine of the horizontal dyeing machine type, in accordance with one preferred embodiment of the present invention.

Referring now the accompanying drawings and initially to FIGS. 1–8, a carrier 10 according to one preferred embodiment of the present invention adapted for supporting textile material in the form of yarn packages 12 for transport to and from a horizontal type textile wet treatment machine in the form of a horizontal package dyeing machine (not shown). As illustrated, the carrier 10 is loaded with the yarn packages 12 to less than full capacity in accordance with the present invention, as more fully described hereinafter.

As is conventional, the carrier 10 is independently movable on a conventional carrier transport assembly (not shown), preferably an arrangement of one or more conveyor belts and/or tracks, for transporting the carrier 10 to and from the dyeing machine, which may be located in an arrangement of multiple dyeing machines commonly served by the same carrier transport assembly.

The carrier 10 basically includes a base structure 14 which serves both to support the yarn packages 12 and as a liquid flow assembly for delivery and withdrawal of treating liquid, e.g., a dye liquor, bleaching solution, water wash, or other appropriate treating fluid, to and through the carrier 10. The base structure 14 is preferably rectangular in overall horizontal cross-section. An upstanding wall 16 having four substantially flat planar sides is affixed to the base structure 14 to extend upwardly from its periphery and thereby forms with the base structure 14 an enclosure 18 for retaining the treating liquid during wet treatment of the yarn packages 12 therein. The top of the carrier's enclosure 18 is open for ease of loading thereinto and unloading therefrom the yarn packages 12.

The liquid flow arrangement formed by the base structure 14 includes two liquid distribution chambers 20,22 formed within the base structure 14 and communicating with the enclosure 18 defined by the base structure 14 and the wall 16, one of the liquid distribution chambers 20,22 serving to deliver treating liquid into the enclosure 18 and the other serving to withdraw treating liquid from the enclosure. Each of the chambers 20,22 extends through substantially the full horizontal extent of the base structure 14 with the chamber 20 disposed above the chamber 22. The upper chamber 20 communicates with the enclosure 18 through openings 24 formed in the top of the base structure 14, while the lower chamber 22 communicates with the enclosure 18 through elongated passages 26 which extend from the lower chamber 22 upwardly through the upper chamber 20.

Each chamber 20,22 has end openings (not shown) at each opposite end of the base structure 14 for communicating with corresponding openings of the chambers of an adjacent carrier 10 disposed in the vessel of the wet treatment machine or, alternatively, with ports of a duct assembly formed in the machine for supplying liquid to and withdrawing liquid from the interior of the machine in a conventional manner.

The carrier 10 is equipped with a plurality of upstanding post assemblies 28, only three of which are shown in FIG. 1, which are mounted to and extend upwardly from the base structure 14 for the purpose of supporting and retaining on each post assembly 28 a stacked column of multiple yarn packages 12. The post assemblies 28 are arranged in longitudinally extending rows spaced sufficiently from one another both longitudinally and transversely within the carrier enclosure 18 to permit non-interfering vertical stacking of the packages 12 thereon.

Figure 2:
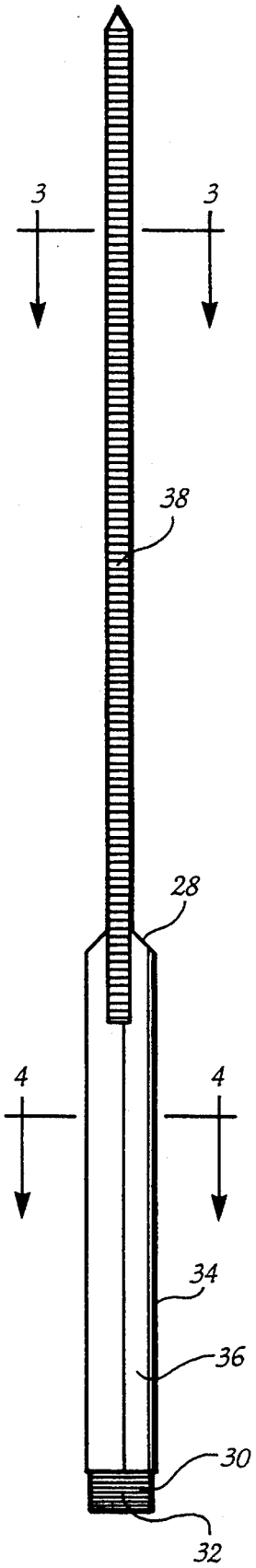
FIG. 2 is a side elevational view of one post assembly of the carrier of FIG. 1.
Figure 3:
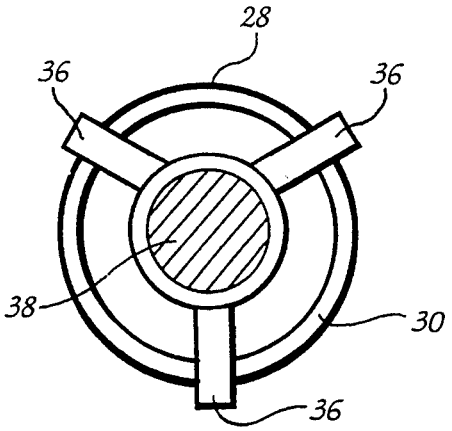
FIG. 3 is a horizontal cross-sectional view of the post assembly of FIG. 2, taken along line 3—3 thereof.
Figure 4:
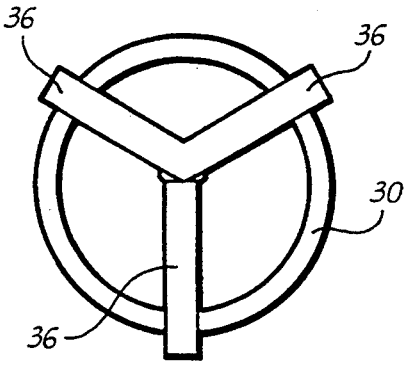
FIG. 4 is another horizontal cross-sectional view of the post assembly of FIG. 1, taken along 4—4 thereof.

Each post assembly 28 is mounted to the base structure 14 in a manner permitting liquid communication between the liquid flow assembly of the base structure 14 and the annular interior of the yarn packages 12. For this purpose, each post assembly 28 is constructed as shown in FIGS. 2–4 with a lower tubular mounting portion 30 having external threads 32 and each liquid opening 24 in the top of the base structure 14 is correspondingly threaded internally for threaded mounting of each post assembly 28 co-axially within a respective liquid opening 24 in the base structure 14 for communication through the tubular mounting portion 30 with the liquid distribution chamber 20. Each post assembly 28 has an elongate package supporting portion 34 formed by three lengthwise struts 36 projecting radially outwardly from one another at equal angular spacings and affixed at one end co-axially to the upper annular edge of the mounting portion 30 of the respective post assembly 28, as best seen in FIG. 4. An elongated threaded spindle rod 38 is rigidly affixed centrally to the struts 36 at the upper end of the package supporting portion 34 of each post assembly 28 in co-axial alignment with the tubular mounting portion 30, as best seen in FIGS. 2 and 3.

The radially transverse dimension of the struts 36 of the package supporting portion 34 are selected to correspond to the inside diameter of a textile yarn package 12 so that a package placed about the package supporting portion 34 of any post assembly 28 will be securely supported by the struts 36 against undesirable lateral movement relative to the post assembly 28. Similarly, the lengthwise dimension of the package supporting portion 34 is selected to correspond to the stacked dimension of a certain number of the packages 12 which has been predetermined to be the minimum number of packages to be supported on each post assembly 28 during any dyeing operation. By way of example, the lengthwise dimension of the struts 36 in the illustrated embodiment is sufficient for laterally supporting a column of three stacked yarn packages 12 on each post assembly 28, although those persons skilled in the art will readily recognize that the package supporting portion 34 may be of any other selected longitudinal dimension as may be desirable.

Each post assembly 28 is provided with a packaging retaining cap 40 having an annular main body 42 defining a central bore (not shown) therethrough threaded correspondingly to the spindle rod 38 and a laterally extending flange plate 44 affixed to the lower side of the cap 40. In this manner, once a stack of yarn packages 12 are placed on each post assembly 28, the package retaining cap 40 for the post assembly may be threadedly mounted on the spindle rod 38 and advanced therealong into retaining engagement with the uppermost package supported on the post assembly (see FIG. 12). Of course, other conventional forms of caps may alternatively be used.

Figure 5:
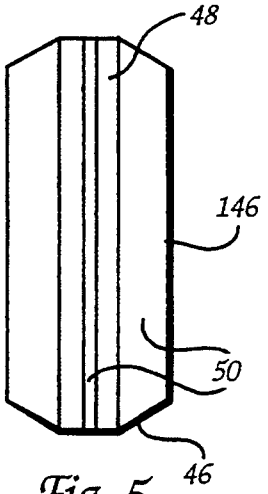
FIGS. 5, 6, and 7, respectively, are side elevational views of three yarn package supporting adapters of differing lengths which may be selectively assembled with the post assemblies of the carrier of FIG. 1.
Figure 6:
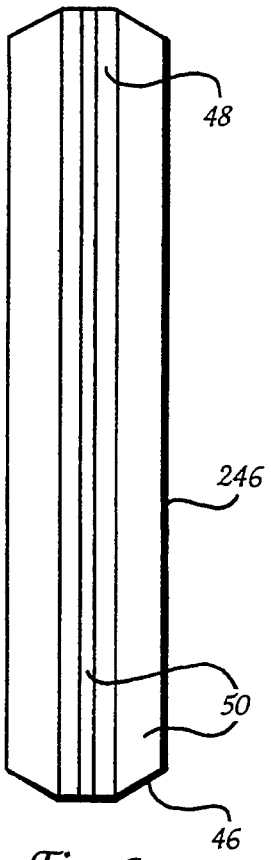
Figure 7:
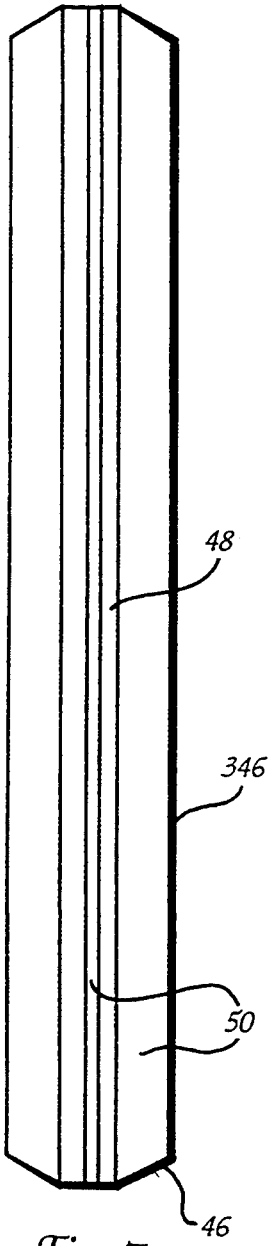
Figure 8:
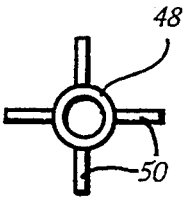
FIG. 8 is an end elevational view of the adapters of FIGS. 5–7.

To facilitate mounting of additional yarn packages 12 on each post assembly 28, up to the predetermined maximum package capacity for the carrier 10, each post assembly 28 is provided with a set of package supporting adapters 46, shown in FIGS. 5, 6, and 7, for selective placement on the spindle rod 38 of the post assembly 28 to effectively extend the length of the package supporting portion 34. Each adapter 46 has a central elongate cylindrical tubular body 48 to which four plate-like struts 50 are affixed at equal radial spacings axially along the full length of the tubular body 48 and projecting radially outwardly therefrom to substantially the same overall transverse dimension as the package supporting portion 34 (see FIG. 8). The individual adapters 46 of each set are of varying axial lengths selected in relation to the axial dimension of the yarn packages 12. More specifically, the adapter 146 of FIG. 5 has an axial length corresponding to that of a single yarn package 12, the adapter 246 of FIG. 6 has an axial length corresponding to that of two stacked yarn packages 12 and the adapter 346 of FIG. 7 has an axial length corresponding to that of three stacked yarn packages 12.

Figure 9:
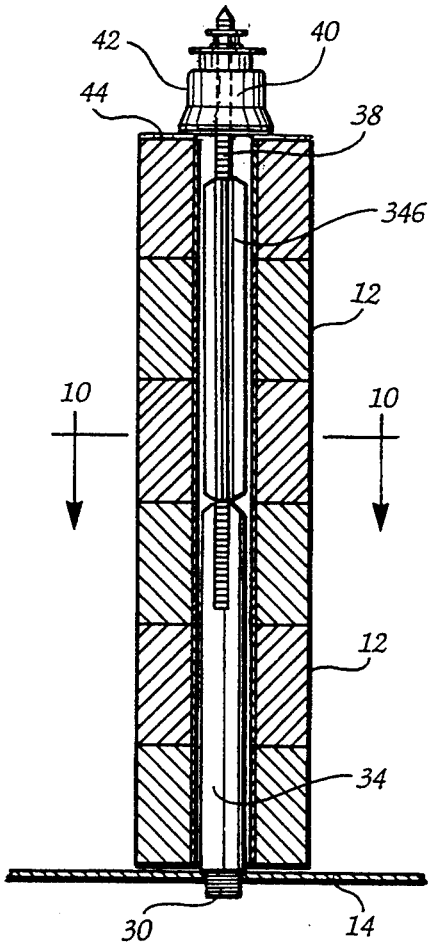
FIG. 9 is a vertical cross-sectional view taken through one post assembly of the carrier of FIG. 1, illustrating the arrangement of the post assembly and one adapter when the carrier is filled to its maximum capacity with yarn packages.
Figure 10:
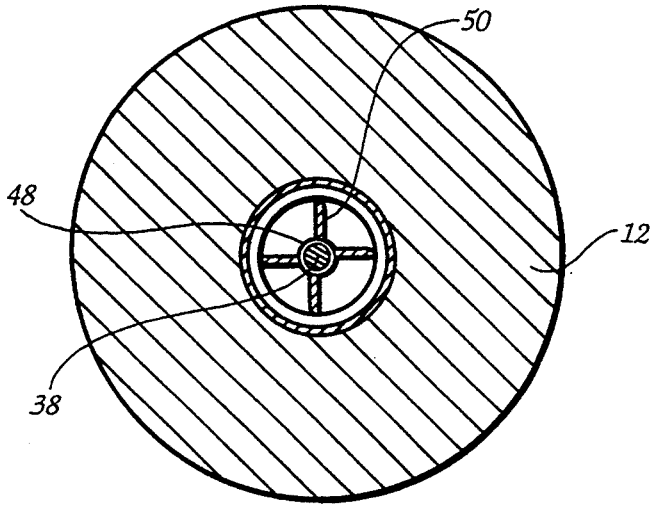
FIG. 10 is a horizontal cross-sectional view through the assembly of the yarn packages, post assembly, and adapter of FIG. 9, taken along 10—10 thereof.

Thus, as will be seen in FIG. 9, when it is desired to load the carrier 10 to its maximum capacity with yarn packages 12, each post assembly 28 is fitted with its associated adapter 346 of FIG. 7 with its tubular main body 48 slidably disposed about the spindle rod 38 to rest in axial adjacency on the upward ends of the struts 36 of the package supporting portion 34. In this manner, the effective length of the package supporting portion 34 is extended by the adapter 46 to enable the post assembly 28 to securely support laterally a column of six stacked yarn packages 12, the struts 36 of the package supporting portion 34 supporting the lower three packages in the stack and the struts 50 of the adapter 346 supporting the upper three packages of the stack. The cap 40 is threaded onto the upper end of the spindle rod 38 into retaining engagement with the uppermost package 12 in the column of six packages.

Figure 11:
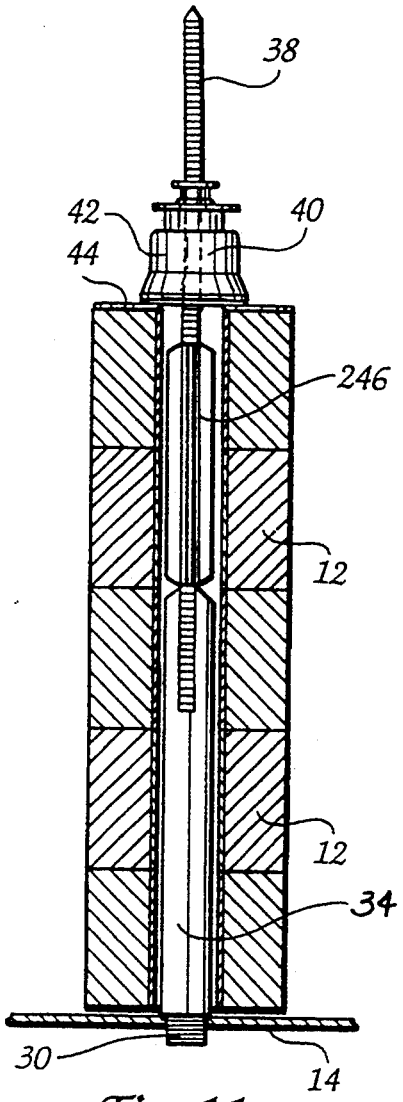
FIG. 11 is another vertical cross-sectional view, similar to FIG. 9, taken through one post assembly of the carrier of FIG. 1, illustrating the arrangement of the post assembly and another adapter when the carrier is filled to a lesser capacity with yarn packages.
Figure 12:
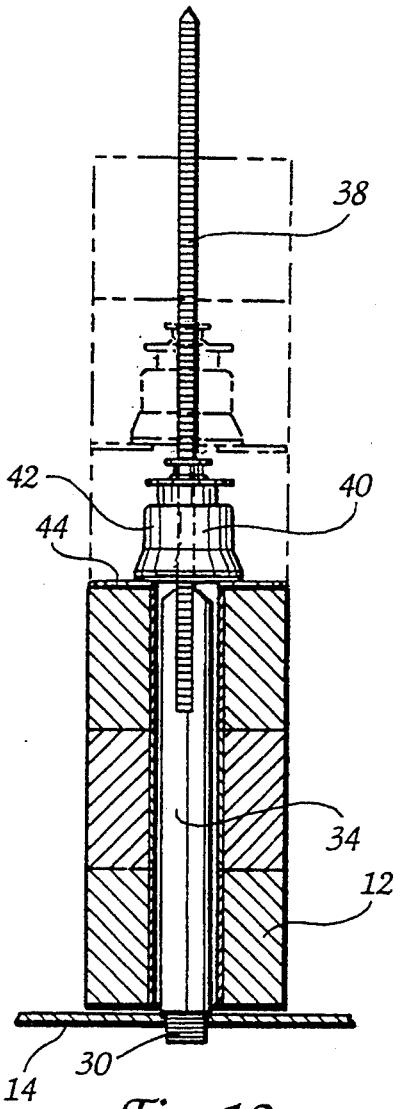
FIG. 12 is a further vertical cross-sectional view, similar to FIGS. 9 and 11, taken through one post assembly of the carrier of FIG. 1, illustrating the arrangement of the post assembly without an adapter when the carrier is filled to its minimum capacity with yarn packages.

Alternatively, when it is desired to place only five packages 12 in a stacked column on each post assembly 28, the adapter 246 of FIG. 6 is utilized instead of the adapter 346, as depicted in FIG. 11. The adapter 146 of FIG. 5 would be utilized if only four yarn packages are to be stacked on each post assembly 28. No adapter is used when the minimum of three packages 12 is placed on each post assembly 28, as depicted in FIG. 12.

Of course, those persons skilled in the art should readily understand and recognize that the embodiment shown in the drawings is merely by way of illustration and example. The post assembly 28 may be of any desired length to handle any desired maximum number of yarn packages. It is also contemplated that the adapters 46 could be utilized in combination rather than alternatively. For example, a series of two or more of the adapters 146 of FIG. 5 could be utilized as necessary to support yarn packages in excess of the minimum number accommodated by the package supporting portion 34. Further, the spindle rod 38 could extend the entire length of the post assembly 28 without any fixed package supporting portion 34, with adapters 46 being utilized to support stacked yarn packages. These and other modifications and adaptations of the present invention are intended to be within the scope and substance of the present invention.

With the post assembly 28, including any adapter 46 which may be utilized, the carrier 10 may be placed in a conventional horizontal-type textile package dyeing machine and wet processing treatment of the yarn packages 12 will proceed in essentially conventional fashion. Specifically, the treating liquid is permitted to flow freely between the upper liquid distribution chamber 20 and the axial interior area of the stacked columns of yarn packages by passing through the tubular mounting portions 30 of the post assemblies 28 and traveling along the post assemblies 28 between the struts 36 of the package supporting portion 34 and, as applicable, the struts 50 of any adapter 46. Depending upon the direction of treating liquid circulation determined by the delivery and withdrawal of the treating liquid through the liquid distribution chambers 20,22, the treating liquid passes between the enclosure 18 and the annular interiors of the stacked package columns in either a radially inward or a radially outward direction. In either case, the progressive ongoing radial flow of the treating liquid through the packages 12 over the course of operation of the machine achieves the desired treatment of the yarn wound on the packages 12. The level of the treating liquid bath within the enclosure 18 can be reduced to the elevation of the cap directly above the stacked yarn packages to submerge the cap and thereby substantially prevent air within the enclosure 18 above the package columns from entering the annular interior area of the stacked package columns. To facilitate such reduction of the liquid level within the carrier 10, the side wall 16 defining the enclosure 18 may be equipped with one or more removable or movable panels (not shown) by which the upper edge of the wall 16 may be effectively lowered at at least one side of the carrier 10 or, alternatively, the side wall 16 could be replaceable in its entirety with another side wail of lesser height.

Referring now to FIGS. 13–17, an alternative embodiment of the present yarn carrier which is particularly adapted for use in supporting yarn packages during dyeing or other wet processing operations in vertical-type wet treatment machines is shown generally at 60. The carrier 60 has a base 62 which includes an upper circular base plate 64 on which a plurality of upstanding package supporting post assemblies 66 (only two of which are shown for sake of simplicity) are mounted at angular spacings in a circular arrangement to extend upwardly from the base plate 64. A lifter bar 68 is affixed to and extends upwardly from the center of the base plate 64 and has a pivoted clevis 70 at its upper end to facilitate lifting and lowering movements of the carrier 60 into and out of a vertical machine utilizing conventional lifting apparatus.

Each post assembly 66 is substantially identical in construction to the post assemblies 28 of the embodiment of FIGS. 1–12, except that each post assembly 66 has a package supporting portion 74 having four equally spaced radial struts 72 formed by welding together a pair of angle members and an annular mounting plate 76 is affixed by a co-axial tubular collar 78 to the struts 72 at the lowermost end of the package supporting assembly 74 instead of the threaded tubular mounting portion 30 of the post assembly 28. The mounting plate 76 of each post assembly 66 is formed with three angularly spaced countersunk bores 80 for affixation of the mounting plate 76 to the base plate 64 utilizing appropriate screws or other fasteners 82. Appropriate fluid flow openings (not shown) are formed in the base plate 64 beneath each post assembly 66 co-axial with the central opening 84 through its mounting plate 76 and collar 78, for fluid communication therethrough with the annular interior of yarn packages 12 stacked and supported on the post assemblies 66, in the same manner as described above with respect to the embodiment of FIGS. 1–12.

Figure 13:
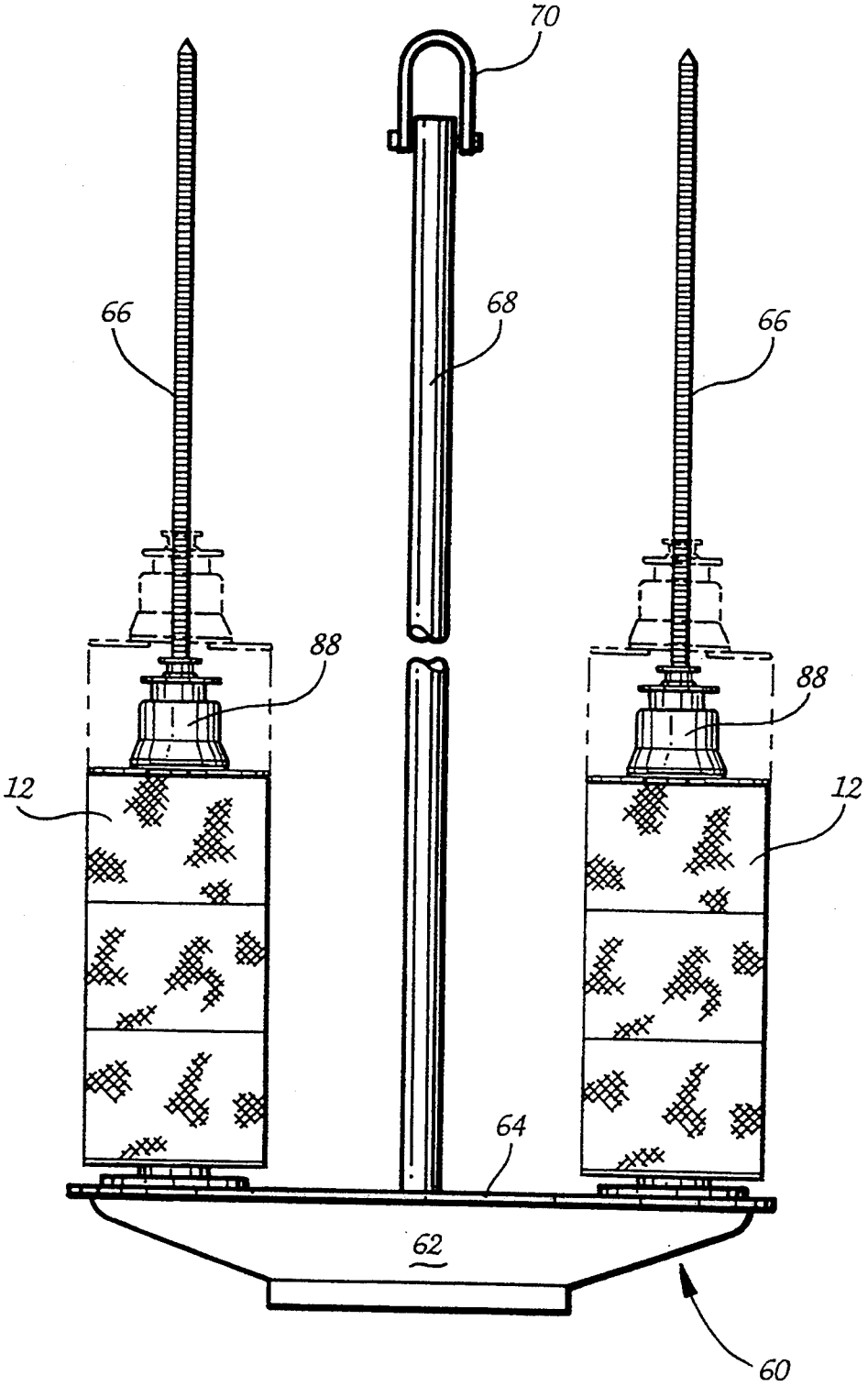
FIG. 13 is a side elevational view of another carrier for supporting textile yarn packages in a textile wet treatment machine of the vertical dyeing machine type, in accordance with another preferred embodiment of the present invention.
Figure 14:
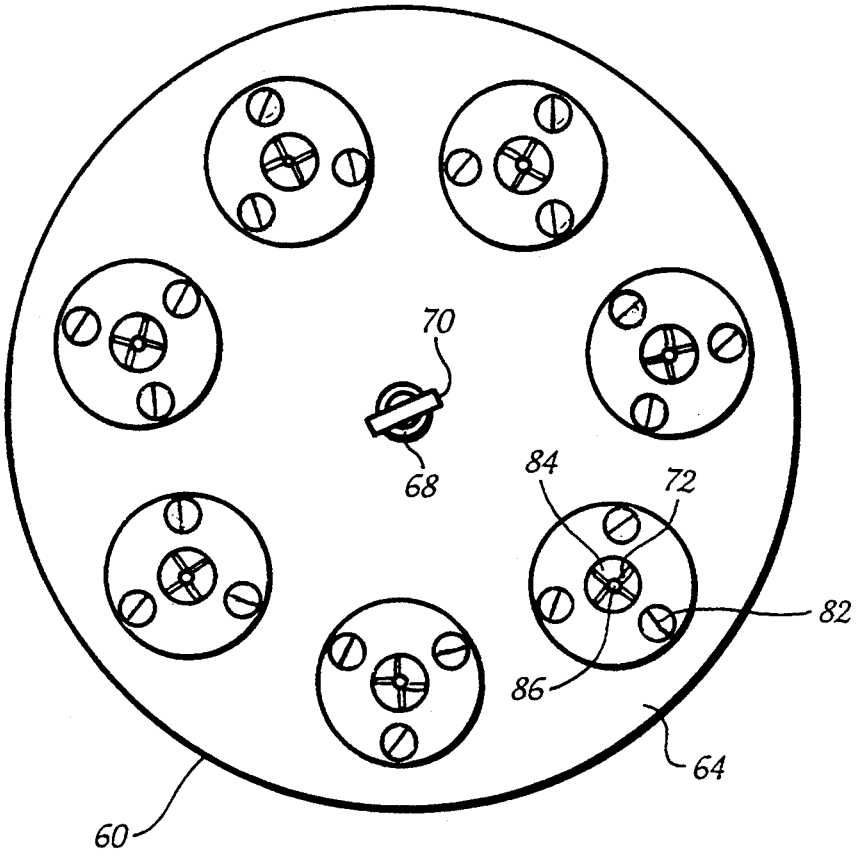
FIG. 14 is a top plan view of the carrier of FIG. 13, with the yarn packages and the package retaining caps removed.
Figure 15:
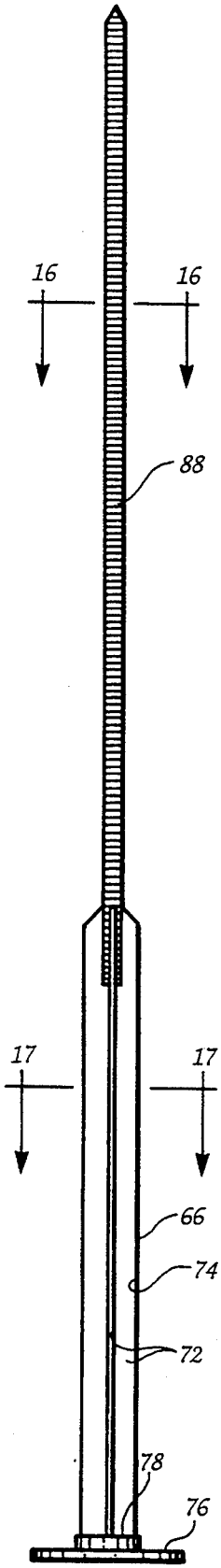
FIG. 15 is a side elevational view of one post assembly of the carrier of FIG. 13.
Figure 16:
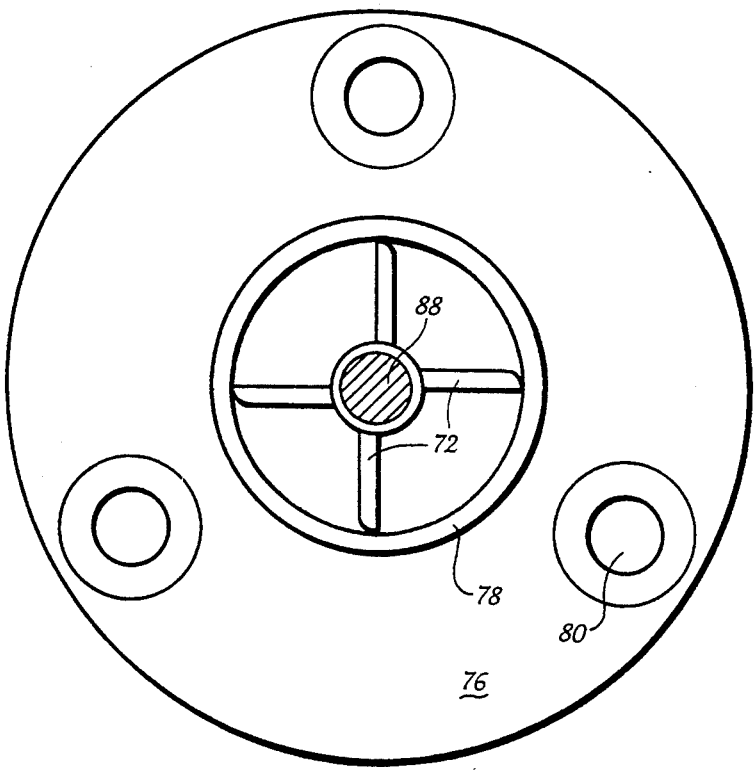
FIG. 16 is a horizontal cross-sectional view of the post assembly of FIG. 15, taken along line 16—16 thereof.
Figure 17:
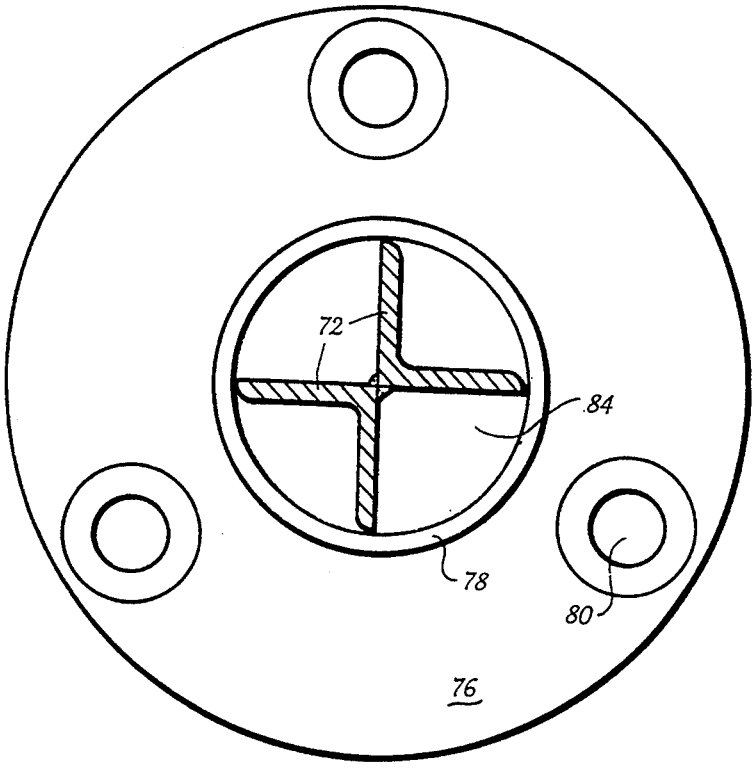
FIG. 17 is another horizontal cross-sectional view of the post assembly of FIG. 15, taken along line 17—17 thereof.

As in the embodiment of FIGS. 1–12, each post assembly 66 includes a threaded spindle rod 86 affixed to and extending from the upper end of the struts 72 and a compatibly threaded package retaining cap 88 for mounting thereon. Each post assembly 66 has an associated set of the adapters 146,246,346 of FIGS. 5–7 for selective placement on the spindle rod 86 so that the package supporting capacity of each post assembly 66 and, in turn, the collective package capacity of the carrier 60 can be selectively varied in identical manner to that described above for the embodiment of FIGS. 1–12. By way of example, the carrier 60 is shown in FIG. 13 as supporting the minimum of three yarn packages 12 on each post assembly 66, with the capability of increasing the capacity of each post assembly 66 to support one or more additional yarn packages by means of the adapters 46 being representatively depicted in broken lines.

As will thus be understood, carriers in accordance with the present invention advantageously enable the liquid level of the treating bath within a textile package dyeing machine of either horizontal or vertical type, or any other appropriate textile wet treatment machine, to be effectively lowered to the elevation of the actual number of packages supported on the carrier whenever the carrier is loaded to less than its full capacity, without the prior necessity of utilizing any form of blocking element or volumetric displacement element and without the risk of drawing air into the pump of the treatment machine or the risk of potential contamination of the treatment bath. In turn, the costs associated with using an excess of treating liquid and the accompanying environmental problems of reclaiming and/or disposing of used treatment liquid are effectively minimized.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A carrier insertable into a vessel of a wet treatment machine for selectively supporting diverse numbers of annular textile material packages during wet treatment operations, the carrier comprising a base, at least one post extending outwardly from the base for mounting a plurality of the textile material packages in series about the post, a package supporting adapter mountable to and demountable from the post, the adapter being of predetermined lengthwise and transverse dimensions for centrally supporting a predetermined number of the annular textile material packages securely on the post during wet treatment operations, and a package retaining cap having means to attach the cap directly to the post, the cap being mountable to and demountable from the poet for selective disposition at differing package retaining positions therealong in engagement with the outermost one of the annular textile material packages supported on the post and the adapter.

2. A carrier for supporting textile material in a wet treatment machine according to claim 1, wherein the package supporting adapter and the post are compatibly configured to permit liquid flow axially through the annular interior of the textile material packages.

3. A carrier for supporting textile material in a wet treatment machine according to claim 1, wherein the package retaining cap is mountable to the post for lengthwise movement therealong.

4. A carrier for supporting textile material in a wet treatment machine according to claim 1, wherein the post comprises a threaded spindle and the package retaining cap is compatibly threaded.

5. A carrier for supporting textile material in a wet treatment machine according to claim 1, wherein the package supporting adapter includes a plurality of radially outwardly extending package supporting struts.

6. A carrier for supporting textile material in a wet treatment machine according to claim 5, wherein the package supporting adapter includes a sleeve for slidable mounting to and demounting from the post, the package supporting struts being affixed to the sleeve.

7. A carrier for supporting textile material in a wet treatment machine according to claim 1, further comprising a set of the package supporting adapters for selective mounting on the post for supporting thereon differing pluralities of textile material packages.

8. A carrier for supporting textile material in a wet treatment machine according to claim 1, wherein the base includes a liquid flow opening and the post includes an annular mounting portion affixed to the base about the liquid flow opening for liquid communication therethrough with the annular interior of the textile material packages supported on the post.

9. A carrier for supporting textile material in a wet treatment machine according to claim 8, wherein the annular mounting portion of the post comprises a mounting plate rigidly affixed to the base.

10. A carrier for supporting textile material in a wet treatment machine according to claim 8, wherein the base comprises a threaded bore defining the liquid flow opening and the mounting portion of the post comprises a threaded tube compatibly engageable in the threaded bore.

11. A carrier for supporting textile material in a wet treatment machine according to claim 1 and further comprising a plurality of the posts affixed to the base in spaced parallel relation to one another.

12. A carrier for supporting textile material in a wet treatment machine according to claim 1, wherein the carrier is configured for horizontal insertion into a horizontal-type wet treatment machine.

13. A carrier for supporting textile material in a wet treatment machine according to claim 1, wherein the carrier is configured for vertical insertion into a vertical-type wet treatment machine.

14. A carrier insertable into a vessel of a wet treatment machine for selectively supporting diverse numbers of annular textile material packages during wet treatment operations, the carrier comprising a base, at least one post extending outwardly from the base for mounting a plurality of the textile material packages in series about the post, the post having a longitudinal package supporting portion adjacent the base and a longitudinal spindle portion extending outwardly from and in alignment with the package supporting portion, the package supporting portion of the post being of predetermined lengthwise and transverse dimensions for centrally supporting a predetermined minimum number of the annular textile material package securely on the post, a package supporting adapter mountable to and demountable from the spindle portion of the post at a position therealong in longitudinal adjacency to the package supporting portion of the post, the adapter being of predetermined lengthwise and transverse dimensions for centrally supporting a predetermined number of the annular textile material packages securely on the post in addition to the predetermined minimum number supported by the package supporting portion of the post, and a package retaining cap mountable to and demountable from the spindle portion of the post for selective disposition at differing package retaining positions therealong in engagement with the outermost one of the annular textile material packages supported on the post.

15. A carrier for supporting textile material in a wet treatment machine according to claim 14, wherein the package supporting portion of the post is configured to permit liquid flow axially through the annular interior of the textile material packages.

16. A carrier for supporting textile material in a wet treatment machine according to claim 15, wherein the package supporting portion comprises a plurality of radially outwardly extending package supporting struts.

17. A carrier for supporting textile material in a wet treatment machine according to claim 14, wherein the package retaining cap is mountable to the spindle portion for lengthwise movement therealong.

18. A carrier for supporting textile material in a wet treatment machine according to claim 17, wherein the spindle portion and the package retaining cap are compatibly threaded.

19. A carrier for supporting textile material in a wet treatment machine according to claim 14, wherein the package supporting adapter is configured to permit liquid flow axially through the annular interior of the textile material packages.

20. A carrier for supporting textile material in a wet treatment machine according to claim 19, wherein the package supporting adapter includes a plurality of radially outwardly extending package supporting struts.

21. A carrier for supporting textile material in a wet treatment machine according to claim 20, wherein the package supporting adapter includes a sleeve for slidable mounting to and demounting from the spindle portion of the post, the package supporting struts being affixed to the sleeve.

22. A carrier for supporting textile material in a wet treatment machine according to claim 14, further comprising a set of the package supporting adapters of differing lengths for selective alternative mounting on the spindle portion of the post for supporting thereon differing pluralities of textile material packages.

23. A carrier for supporting textile material in a wet treatment machine according to claim 14, wherein the base includes a liquid flow opening and the post includes an annular mounting portion affixed to the base about the liquid flow opening for liquid communication therethrough with the annular interior of the textile material packages supported on the post.

24. A carrier for supporting textile material in a wet treatment machine according to claim 23, wherein the annular mounting portion of the post comprises a mounting plate rigidly affixed to the base.

25. A carrier for supporting textile material in a wet treatment machine according to claim 23, wherein the base comprises a threaded bore defining the liquid flow opening and the mounting portion of the post comprises a threaded tube compatibly engageable in the threaded bore.

26. A carrier for supporting textile material in a wet treatment machine according to claim 14 and further comprising a plurality of the posts affixed to the base in spaced parallel relation to one another.

27. A carrier for supporting textile material in a wet treatment machine according to claim 14, wherein the carrier is configured for horizontal insertion into a horizontal-type wet treatment machine.

28. A carrier for supporting textile material in a wet treatment machine according to claim 14, wherein the carrier is configured for vertical insertion into a vertical-type wet treatment machine.

29. A carrier insertable into a vessel of a wet treatment machine for selectively supporting diverse numbers of annular textile material packages during wet treatment operations, the carrier comprising a base, at least one post extending outwardly from the base for mounting differing pluralities of the textile material packages in series about the post, and a package retaining cap having means to selectively attach the cap directly to the post at varying locations along a predominant portion of the length of the post for selective disposition at differing package retaining positions therealong in engagement with the outermost one of the annular textile material packages supported on the poet.

30. A carrier for supporting textile material in a wet treatment machine according to claim 29, wherein the post is configured to permit liquid flow axially through the annular interior of the textile material packages.

31. A carrier for supporting textile material in a wet treatment machine according to claim 29, wherein the package retaining cap is mountable to the post for lengthwise movement therealong.

32. A carrier for supporting textile material in a wet treatment machine according to claim 29, wherein the post comprises a threaded spindle and the package retaining cap is compatibly threaded.

33. A carrier for supporting textile material in a wet treatment machine according to claim 29, wherein the base includes a liquid flow opening and the post includes an annular mounting portion affixed to the base about the liquid flow opening for liquid communication therethrough with the annular interior of the textile material packages supported on the post.

34. A carrier for supporting textile material in a wet treatment machine according to claim 33, wherein the annular mounting portion of the post comprises a mounting plate rigidly affixed to the base.

35. A carrier for supporting textile material in a wet treatment machine according to claim 33, wherein the base comprises a threaded bore defining the liquid flow opening and the mounting portion of the post comprises a threaded tube compatibly engageable in the threaded bore.

36. A carrier for supporting textile material in a wet treatment machine according to claim 29 and further comprising a plurality of the posts affixed to the base in spaced parallel relation to one another.

37. A carrier for supporting textile material in a wet treatment machine according to claim 29, wherein the carrier is configured for horizontal insertion into a horizontal-type wet treatment machine.

38. A carrier for supporting textile material in a wet treatment machine according to claim 29, wherein the carrier is configured for vertical insertion into a vertical-type wet treatment machine.

* * * * *

UNITED STATES PATENT AND TRADEMARK OFFICE

CERTIFICATE OF CORRECTION

PATENT NO. : 5,442,939

DATED : August 22, 1995

INVENTOR(S) : David R. Crawford; Matthew A. Meeker; Thomas W. Van Scyoc

It is certified that error appears in the above-identified patent and that said Letters Patent is hereby corrected as shown below:

In the Abstract, line 4 (not including heading), after "capacity" delete "," and insert therefor -- . --.

In the Abstract, line 8 (not including heading), after "therewith" delete "," and insert therefor -- . --.

Column 1, line 20, delete "Cylindrical" and insert therefor -- cylindrical --.

Column 3, line 38, after "along" insert -- line --.

Column 3, line 52, after "along" insert -- line --.

Column 4, line 15, after "now" insert -- to --.

Column 5, line 41, delete "are" and insert therefor -- is --.

Column 7, line 38, delete "wail" and insert therefor -- wall --.

Column 9, line 11, delete "poet" and insert therefor -- post --.

Column 10, line 16, delete "package" and insert therefor -- packages --.

Column 12, line 2, delete "poet" and insert therefor -- post --.

Signed and Sealed this

Thirtieth Day of April, 1996

*Attest:*

BRUCE LEHMAN

*Attesting Officer*

*Commissioner of Patents and Trademarks*